US012492857B2

(12) United States Patent
Keeling

(10) Patent No.: US 12,492,857 B2
(45) Date of Patent: Dec. 9, 2025

(54) TILTING BIN IN A DOOR-IN-DOOR REFRIGERATOR APPLIANCE

(71) Applicant: Haier US Appliance Solutions, Inc., Wilmington, DE (US)

(72) Inventor: Stewart Keeling, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 98 days.

(21) Appl. No.: 18/610,839

(22) Filed: Mar. 20, 2024

(65) Prior Publication Data

US 2025/0297798 A1 Sep. 25, 2025

(51) Int. Cl.
*F25D 23/02* (2006.01)
*F25D 23/04* (2006.01)

(52) U.S. Cl.
CPC ..... *F25D 23/028* (2013.01); *F25D 23/04* (2013.01); *F25D 2323/021* (2013.01); *F25D 2323/023* (2013.01)

(58) Field of Classification Search
CPC .. F25D 23/028; F25D 23/04; F25D 2323/021; F25D 2323/023; A47B 46/00; A47B 46/005; A47B 96/16
See application file for complete search history.

(56) References Cited

U.S. PATENT DOCUMENTS 2,136,558 A * 11/1938 Manshel ..... F25D 23/04 62/266
2,155,967 A * 4/1939 Carroll ..... F25D 23/04 312/405.1
2,942,438 A * 6/1960 Schmeling ..... F25D 23/04 62/377
3,218,111 A * 11/1965 Steiner ..... F25D 23/04 312/405.1
4,186,978 A * 2/1980 Thomson ..... F25D 23/04 211/80
6,742,855 B2 * 6/2004 Whitaker ..... F25D 23/04 312/405.1
7,111,914 B2 * 9/2006 Avendano ..... F25D 23/04 312/405.1
7,204,092 B2 * 4/2007 Azcarate Castrellon ..... F25C 1/04 62/72

(Continued)

FOREIGN PATENT DOCUMENTS

JP 2017072285 A * 4/2017 ..... F25C 1/25
KR 20100106045 A * 10/2010 ..... F25D 23/04

*Primary Examiner* — Hanh V Tran
(74) *Attorney, Agent, or Firm* — Dority & Manning, P.A.

(57) ABSTRACT

A door-in-door assembly includes an inner door with a frame defining an opening. The inner door is rotatable between a closed position and an open position. The door-in-door assembly further includes an outer door. The door-in-door assembly also includes a tilting bin assembly mounted within the opening of the inner door. The tilting bin assembly includes a bin defining an opening at a top side of the bin and includes a first nub and a second nub positioned on a first side. A mounting plate is removably coupled to the frame of the inner door. The mounting plate defines a first channel and a second channel configured to receive the first nub and the second nub, respectively, of the bin. The first nub is configured to translate within the first channel and the second nub is configured to translate within the second channel.

20 Claims, 7 Drawing Sheets

(56) References Cited

U.S. PATENT DOCUMENTS

| | | | | |
|---|---|---|---|---|
| 7,469,553 | B2 * | 12/2008 | Wu | F25C 5/182 312/405.1 |
| 7,472,974 | B2 * | 1/2009 | Czach | F25D 23/04 312/405.1 |
| 7,775,613 | B2 * | 8/2010 | Williams | A47B 46/005 312/325 |
| 7,832,227 | B2 | 11/2010 | Wu et al. | |
| 8,128,184 | B2 * | 3/2012 | Allard | F25D 23/04 312/405.1 |
| 8,262,176 | B2 | 9/2012 | Lee | |
| 8,312,735 | B2 * | 11/2012 | Fulton | F25D 23/04 62/344 |
| 8,864,252 | B1 * | 10/2014 | Rodriguez Cobas | F25D 23/04 312/405.1 |
| 8,925,343 | B1 * | 1/2015 | Flores | F25D 23/04 62/344 |
| 9,127,878 | B2 * | 9/2015 | Gossens | F25D 25/025 |
| 9,903,641 | B1 * | 2/2018 | Shrader | F25D 25/025 |
| 9,915,470 | B2 * | 3/2018 | Kim | F25D 23/025 |
| 10,041,723 | B2 * | 8/2018 | Lee | F25D 11/00 |
| 10,228,183 | B2 * | 3/2019 | Jung | F25D 25/025 |
| 10,260,790 | B2 * | 4/2019 | Hottenroth | F25D 23/028 |
| 10,443,923 | B2 * | 10/2019 | Jeon | F25D 23/025 |
| 10,508,851 | B2 * | 12/2019 | Hong | F25C 1/04 |
| 10,684,065 | B2 * | 6/2020 | Kim | F25D 23/025 |
| 10,914,507 | B2 * | 2/2021 | Karl | F25D 23/025 |
| 11,493,251 | B2 * | 11/2022 | Park | F25C 1/24 |
| 2007/0235397 | A1 * | 10/2007 | Wannop | A47B 88/60 211/81 |
| 2008/0168794 | A1 | 7/2008 | Cho et al. | |

* cited by examiner

TILTING BIN IN A DOOR-IN-DOOR REFRIGERATOR APPLIANCE

FIELD OF THE INVENTION

The subject matter of the present disclosure relates generally to door-in-door refrigerator appliances, more specifically, to systems for bins within door-in-door refrigerator appliances.

BACKGROUND OF THE INVENTION

Refrigerator appliances generally include a cabinet that defines a food storage chamber. In addition, refrigerator appliances also generally include a door rotatably hinged to the cabinet to permit selective access to food items stored in the fresh food storage chamber. Certain refrigerator appliances, commonly referred to as door-in-door refrigerator appliances, may include an additional door positioned within the door and selectively accessible through an outer door rotatably hinged to the additional door.

A typical problem faced in current refrigerator appliances is the utilization of space within the storage chambers. Typical refrigerator appliances provide adjustable drawers that may be set to various heights within the fresh food chamber. In refrigerators having a door-in-door system, the additional door may include additional storage bins for the storage of more food items. However, due to tight spaces between bins and/or the position of a user, food items in the additional door storage may be difficult to access.

Accordingly, accessible bins within door-in-door refrigerator appliances would be advantageous.

BRIEF DESCRIPTION OF THE INVENTION

Aspects and advantages of the invention will be set forth in part in the following description, may be apparent from the description, or may be learned through practice of the invention.

In one example embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber extends between a top and a bottom along the vertical direction, a first side and a second side along the lateral direction, and a front and a back along the transverse direction. The refrigerator appliance also includes a door-in-door assembly. The door-in-door assembly includes an upper hinge assembly and a lower hinge assembly. The door-in-door assembly also includes an inner door. The inner door includes a frame defining an opening. The frame includes an inner surface and an outer surface. The inner door is rotatable between a closed position and an open position. The door-in-door assembly further includes an outer door. Both of the inner door and the outer door are rotatably coupled to the upper hinge assembly and the lower hinge assembly. The outer door is rotatable independently from the inner door. The door-in-door assembly also includes a tilting bin assembly mounted within the opening of the inner door. The tilting bin assembly includes a bin positioned within a first inner side wall and a second inner side wall of the inner door. The bin defines an opening at a top side of the bin and includes a first nub and a second nub positioned on a first side. A mounting plate removably coupled to the frame of the inner door. The mounting plate defines a first channel and a second channel configured to receive the first nub and the second nub, respectively, of the bin. The first nub is configured to translate within the first channel and the second nub is configured to translate within the second channel, whereby, the bin tilts between an inward position and an outward position. The inward position of the bin includes the opening of the bin orientated towards the inner surface of the frame of the inner door when the inner door is in the open position. The outward position of the bin includes the opening of the bin orientated towards the outer surface of the frame of the inner door when the inner door is in the closed position.

In another example embodiment, a door-in-door assembly for a refrigerator appliance is provided. The door-in-door assembly defines a vertical direction, a lateral direction, and a transverse direction. The vertical, lateral, and transverse directions are mutually perpendicular. The door-in-door assembly includes an upper hinge assembly and a lower hinge assembly. The door-in-door assembly also includes an inner door. The inner door includes a frame defining an opening. The frame includes an inner surface and an outer surface. The inner door is rotatable between a closed position and an open position. The door-in-door assembly further includes an outer door. Both of the inner door and the outer door are rotatably coupled to the upper hinge assembly and the lower hinge assembly. The outer door is rotatable independently from the inner door. The door-in-door assembly also includes a tilting bin assembly mounted within the opening of the inner door. The tilting bin assembly includes a bin positioned within a first inner side wall and a second inner side wall of the inner door. The bin defines an opening at a top side of the bin and includes a first nub and a second nub positioned on a first side. A mounting plate removably coupled to the frame of the inner door. The mounting plate defines a first channel and a second channel configured to receive the first nub and the second nub, respectively, of the bin. The first nub is configured to translate within the first channel and the second nub is configured to translate within the second channel, whereby, the bin tilts between an inward position and an outward position. The inward position of the bin includes the opening of the bin orientated towards the inner surface of the frame of the inner door when the inner door is in the open position. The outward position of the bin includes the opening of the bin orientated towards the outer surface of the frame of the inner door when the inner door is in the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
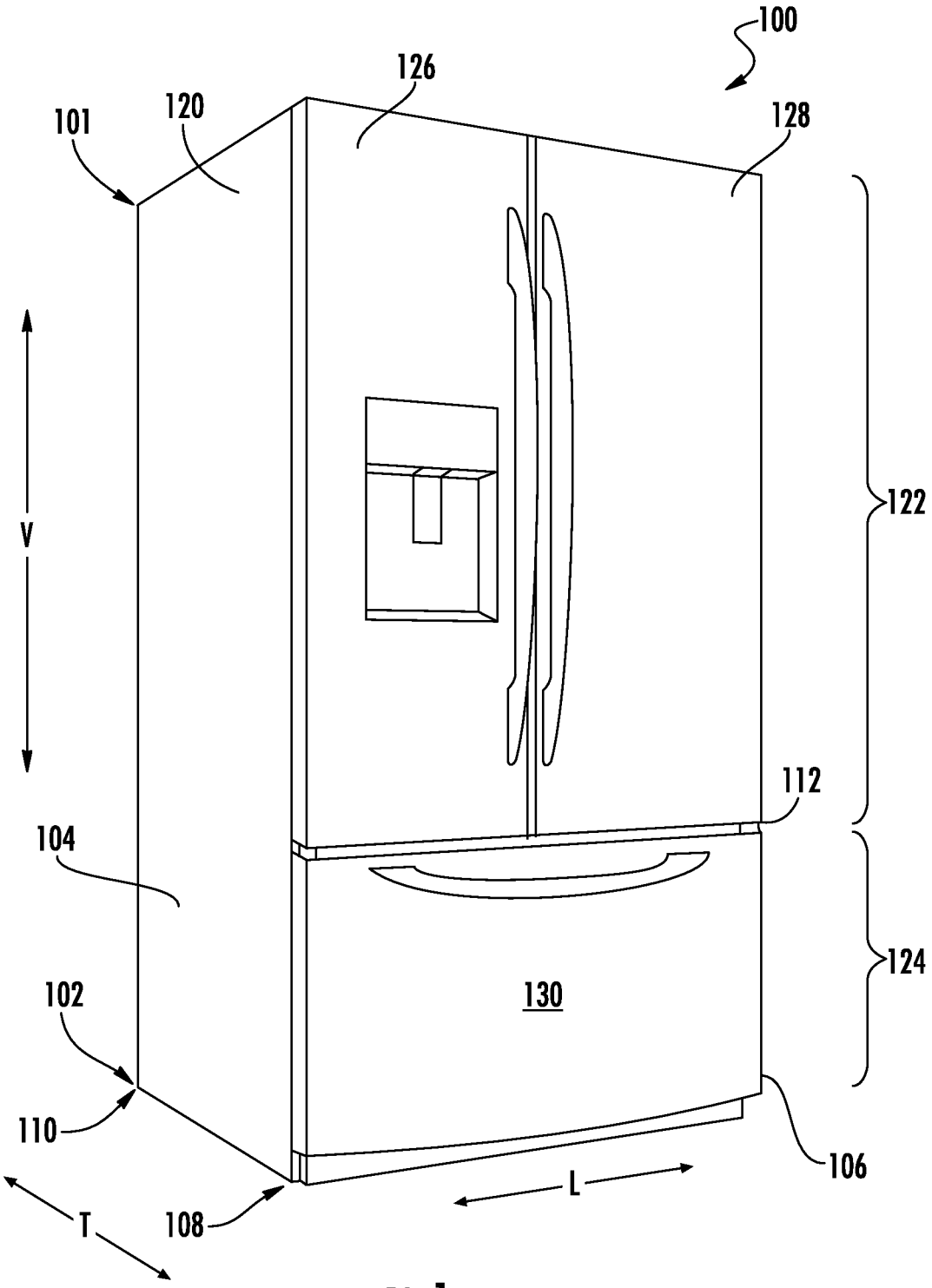
FIG. 1 provides a perspective view of a refrigerator appliance according to example embodiments of the present disclosure with refrigerator doors and a freezer door shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment may be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

The word "example" is used herein to mean "serving as an example, instance, or illustration." In addition, references to "an embodiment" or "one embodiment" does not necessarily refer to the same embodiment, although it may. Any implementation described herein as "example" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations may be made in the present invention without departing from the scope of the invention. For instance, features illustrated or described as part of one embodiment may be used with another embodiment to yield a still further embodiment. Thus, it is intended that the present invention covers such modifications and variations as come within the scope of the appended claims and their equivalents.

Figure 2:
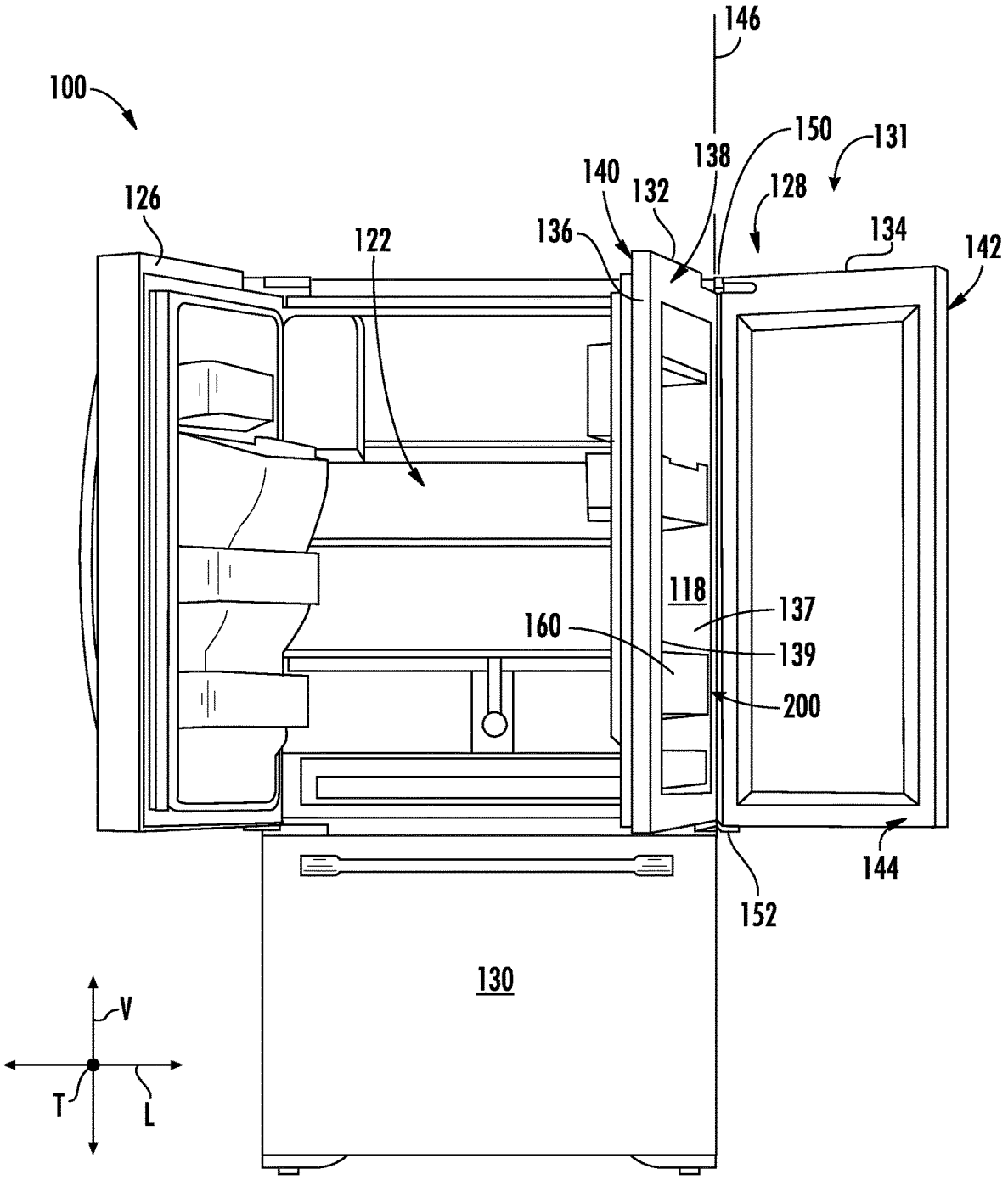
FIG. 2 provides a front elevation view of the refrigerator appliance of FIG. 1 with refrigerator doors shown in an open position.

FIG. 1 provides a perspective view of a refrigerator appliance 100 according to example embodiments of the present subject matter. FIG. 2 provides a front elevation view thereof with the chamber doors shown in an open position. As shown in FIG. 1, refrigerator appliance 100 includes a cabinet 120 that extends between a top 101 and a bottom 102 along a vertical direction V. Cabinet 120 also extends between a first side 104 and a second side 106 along a lateral direction L and between a front 108 and a rear 110 along a transverse direction T. Vertical direction V, lateral direction L, and transverse direction T are mutually perpendicular and form an orthogonal direction system.

Cabinet 120 defines chilled chambers for receipt of food items for storage. In particular, cabinet 120 defines a refrigerated chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure matter apply to other types and styles of refrigerator appliances, such as e.g., top mount refrigerator appliances, side-by-side style refrigerator appliances, and wine storage refrigerators. Moreover, the benefits of the present disclosure matter may likewise apply to freezer appliances, e.g., upright freezers. Consequently, the description set forth herein is for example purposes only and is not intended to be limiting in any aspect to any particular type of consumer appliance.

For this embodiment, refrigerator doors, hereinafter doors 126, 128, are configured in a French door configuration and are rotatably hinged or mounted to an edge of cabinet 120 for selectively accessing refrigerated chamber 122. Door 126 (i.e., left door) is rotatably mounted or hinged to cabinet 120 at first side 104 of cabinet 120. Door 128 (i.e., right door) is rotatably mounted or hinged to cabinet 120 at the right, or second side 106 of cabinet 120. More specifically, door 128 is rotatably mounted to cabinet 120 via upper hinge assembly 150 located at the top 101 front 108 corner of the door 128 and a lower hinge assembly 152 located at the lower portion 112 of door 128 (both hinges to be described in greater detail below). In some embodiments, door 126 may be attached to cabinet 120 with hinge assemblies similar to upper and lower hinge assemblies 150, 152. In FIG. 1, doors 126, 128 are shown in a closed position. In FIG. 2, doors 126, 128 are shown in an open position.

As shown in FIG. 2, door 128 comprises a door-in-door assembly 131. As such, door 128 includes inner door 132 and an outer door 134, both of which are shown in an open position in FIG. 2. In other embodiments, door 126 may likewise have a door-in-door configuration. In this way, one or both of doors 126, 128 may have door-in-door configurations. In general, a door-in-door type refrigerator appliance door provides an outer door enclosing a door compartment within a door frame or inner door, the outer door providing controlled access to the door compartment. The door-in-door type door also provides a door assembly, including the outer door and the inner door, that provides controlled access to a refrigerated compartment within the cabinet. As illustrated and discussed in the present disclosure, the right-side door, door 128, for refrigerated chamber 122 is used to illustrate features of the present disclosure. This is for convenience only, as one of ordinary skill in the art will recognize that the disclosed features may be applied to other door locations, such as door 126 or a hinged freezer chamber door (not shown). Accordingly, illustrations and discussions of the right-side door-in-door arrangement are for illustration only and not intended to be limiting.

Inner door 132 includes a door frame 136 that has an outer surface 138 and an opposing inner surface 140 that faces toward refrigerated chamber 122 when inner door 132 is in a closed position. Inner door 132 is rotatably hinged to cabinet 120, e.g., such that inner door 132 is movable between a closed position (FIG. 1) and an open position (FIG. 2) to permit selective access to refrigerated chamber 122. In particular, inner door 132 may be rotatably coupled or mounted directly to cabinet 120 at the second side 105 of cabinet 120 via upper and lower hinge assemblies 150, 152. Frame 136 of inner door 132 defines an opening 118 extending through the outer and inner surfaces 138, 140 and may extend into refrigerated chamber 122. Frame 136 extends around a perimeter of the opening 118 defined by inner door 132. Frame 136 may extend into the refrigerated chamber 122 when inner door 132 is in the closed position.

Outer door 134 includes an outer surface 142 and an opposing inner surface 144. The outer surface 142 faces an exterior of refrigerator appliance 100 and inner surface 144 faces toward refrigerated chamber 122 or toward the interior of refrigerator appliance 100 when outer door 134 is in the closed position. As shown, outer door 134 is rotatably coupled or hinged to inner door 132 via upper and lower hinge assemblies 150, 152. In particular in the present embodiment, inner door 132 and outer door 134 are both rotatably coupled with hinge assemblies 150, 152. In this way, door-in-door refrigerator appliance door assembly 131 (including inner door 132 and outer door 134) is directly rotatably coupled with the opening defined by inner door 132. In some embodiments, outer door 134 may rotate independently from inner door 132 and thus may permit selective access to opening 118 of inner door 132, while inner door is in the closed position.

Inner and outer doors 132, 134 may generally move in the same direction. Specifically, inner and outer doors 132, 134 may each move away or swing out from refrigerated chamber 122 of refrigerator appliance 100 when moving toward their respective open positions, or the fully open position for inner and outer doors 132, 134. Moreover, inner and outer doors 132, 134 may each move toward refrigerated chamber 122 of refrigerator appliance 100 when moving toward their respective closed positions. As illustrated, door assembly 131 (i.e., inner and outer doors 132, 134) rotate about an axis 146 in a clockwise direction (when viewed vertically downward along axis 146) to close the doors 132, 134, and rotate in a counterclockwise direction to open the doors 132, 134.

In some embodiments, refrigerator appliance 100 includes a gasket positioned on inner surface 144 of outer door 134. As outer door 134 moves toward the closed position, outer door 134 may compress the gasket against outer surface 138 of inner door 132. Specifically, the gasket may seal against outer surface 138 of inner door 132 to enclose refrigerated chamber 122. In alternative embodiments, the gasket may be positioned on outer surface 138 of inner door 132, and as outer door 134 moves toward the closed position, inner door 132 may compress the gasket against inner surface 144 of outer door 134. More specifically, the gasket may seal against inner surface 144 of outer door 134. It should be appreciated that the gasket may be formed of any suitable material. For example, in some embodiments, the gasket may be formed of a resilient rubber or plastic material.

As further shown in FIGS. 1 and 2, a freezer door 130 is arranged below doors 126, 128 for selectively accessing freezer chamber 124 (FIG. 1). Although freezer door 130 is configured as a pull-out drawer in FIGS. 1 and 2, in other example embodiments, refrigerator appliance 100 may include one or more freezer doors that are rotatably hinged or mounted to cabinet 120 in the same or similar fashion as doors 126, 128. In some embodiments, hinged freezer doors may include door-in-door features. For example, in a side-by-side refrigerator, the chilled chamber is vertically segmented with a freezer compartment on one side and a refrigerator compartment on the other. As such, the doors 126, 128 may extend from the top 101 to the bottom 102 of the cabinet 120, with door 126 pivoted on the left and door 128 pivoted in the right. In such a configuration, either or both doors 126, 128 may include a door-in-door assembly similar to door-in-door assembly 131.

Figure 3:
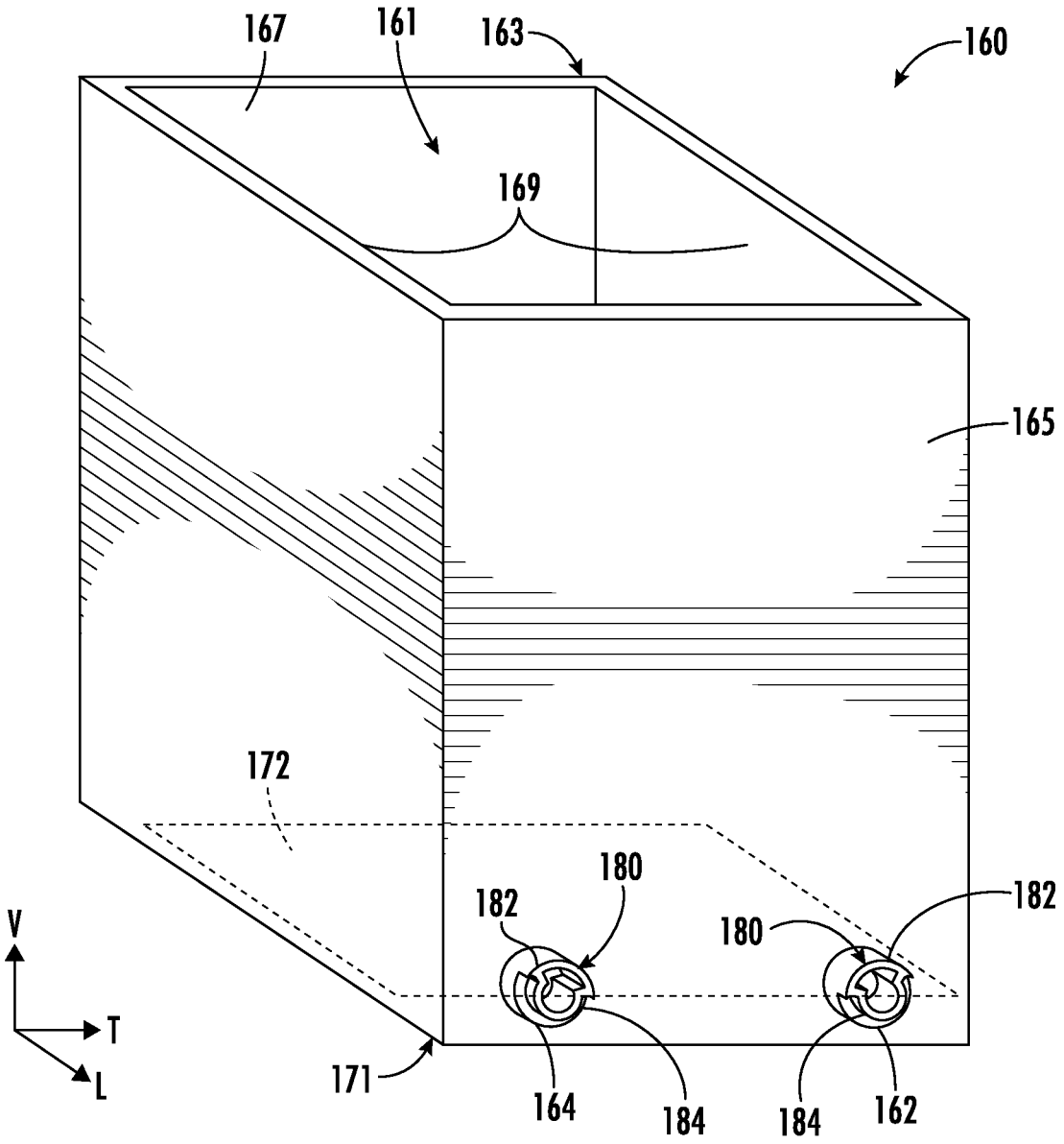
FIG. 3 provides a perspective view of an example bin according to aspects of the present disclosure.
Figure 4:
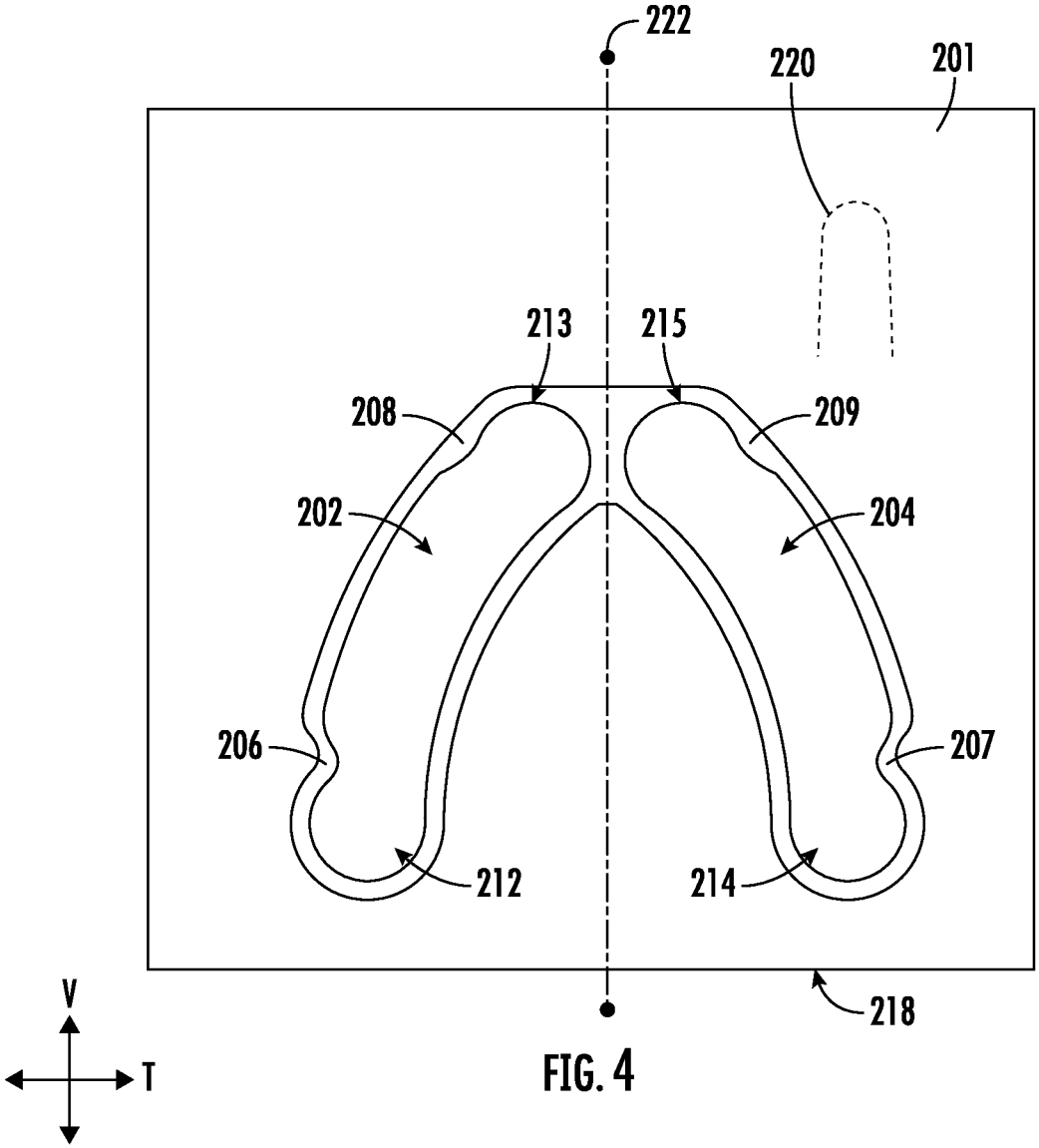
FIG. 4 provides a front view of an example mounting plate for the bin of FIG. 3 according to aspects of the present disclosure.
Figure 5:
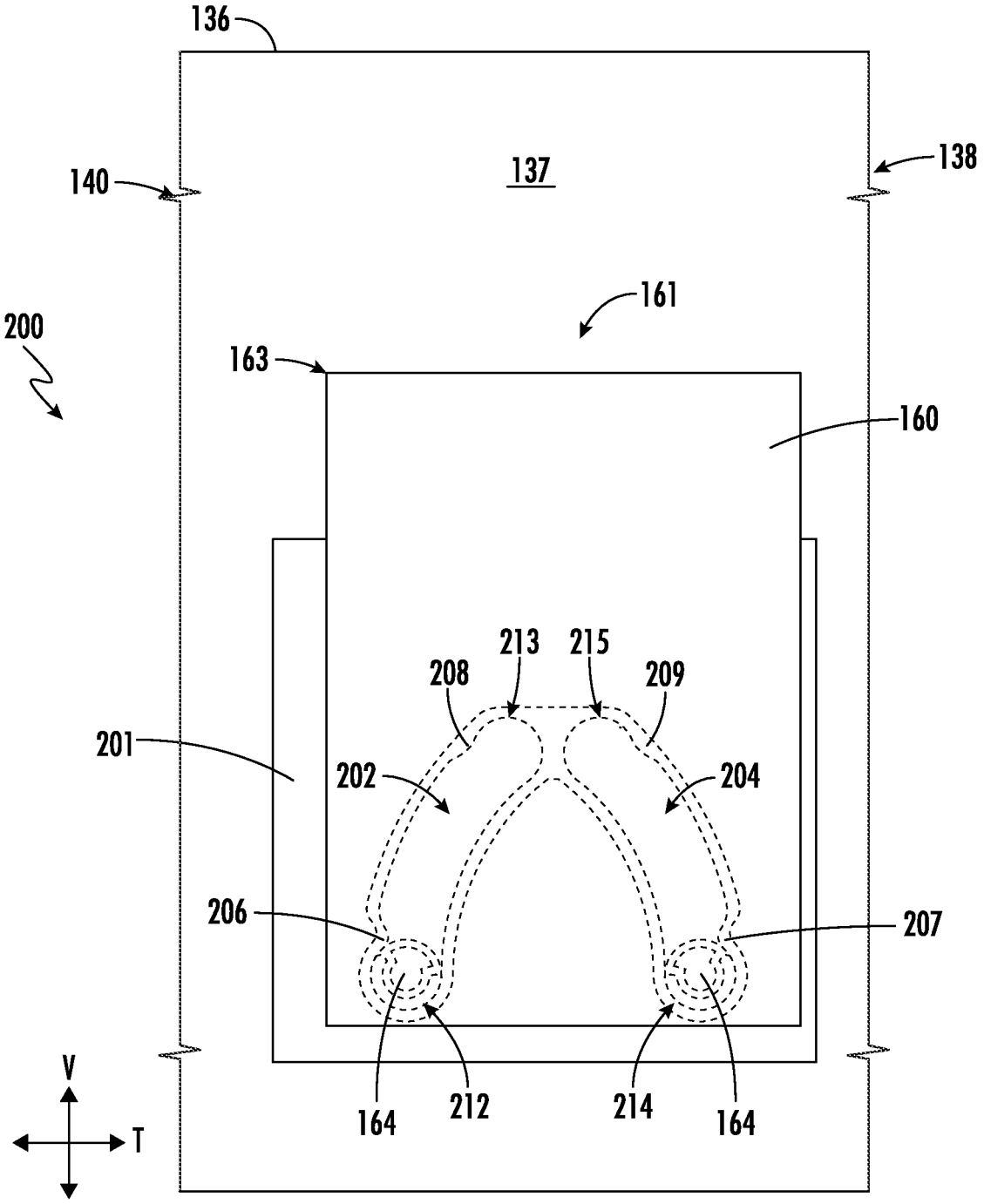
FIG. 5 provides a schematic side view of an example tilting bin assembly in a neutral position according to aspects of the present disclosure.
Figure 6:
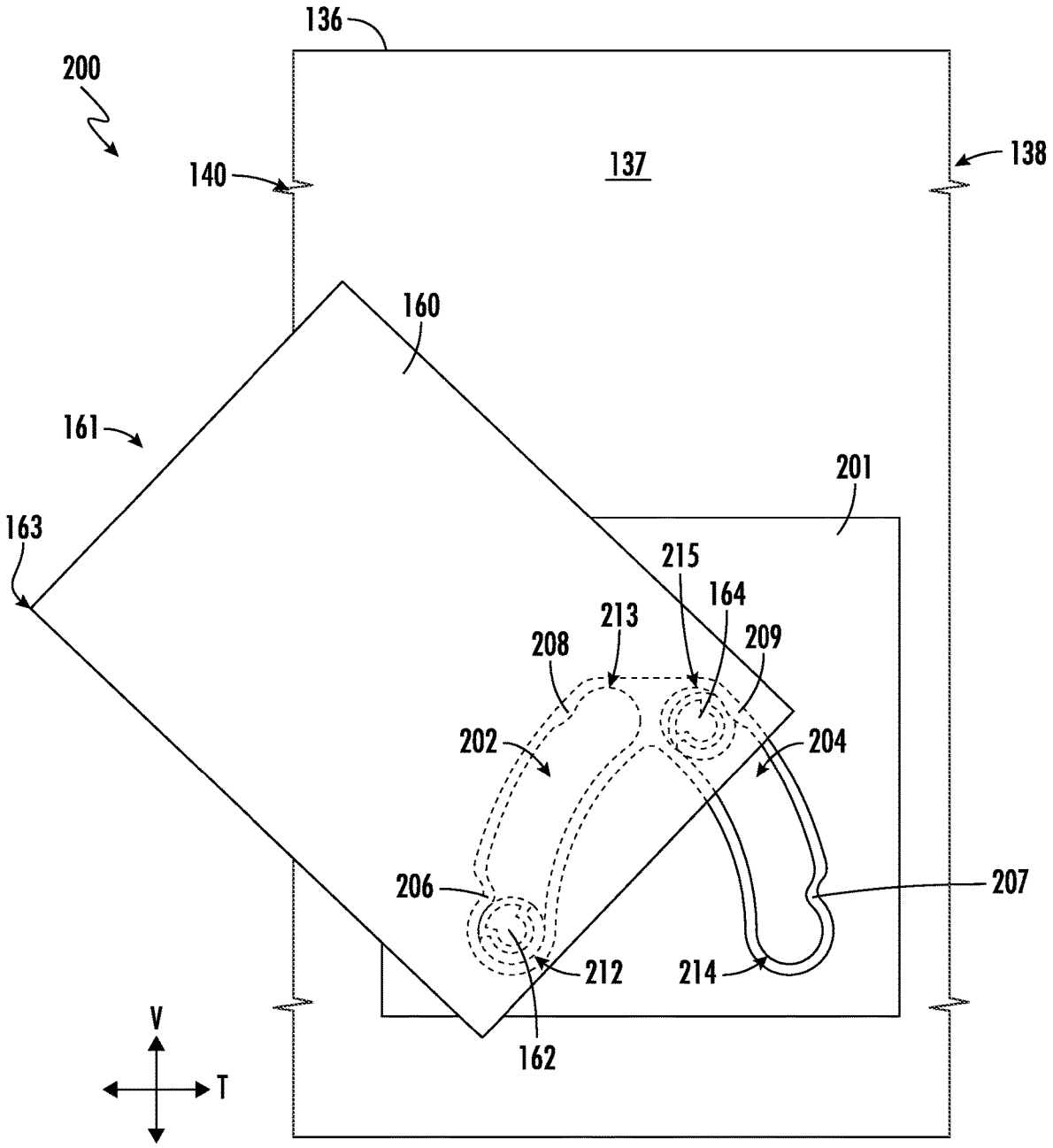
FIG. 6 provides a schematic side view of the tilting bin assembly of FIG. 5 in an inward position.
Figure 7:
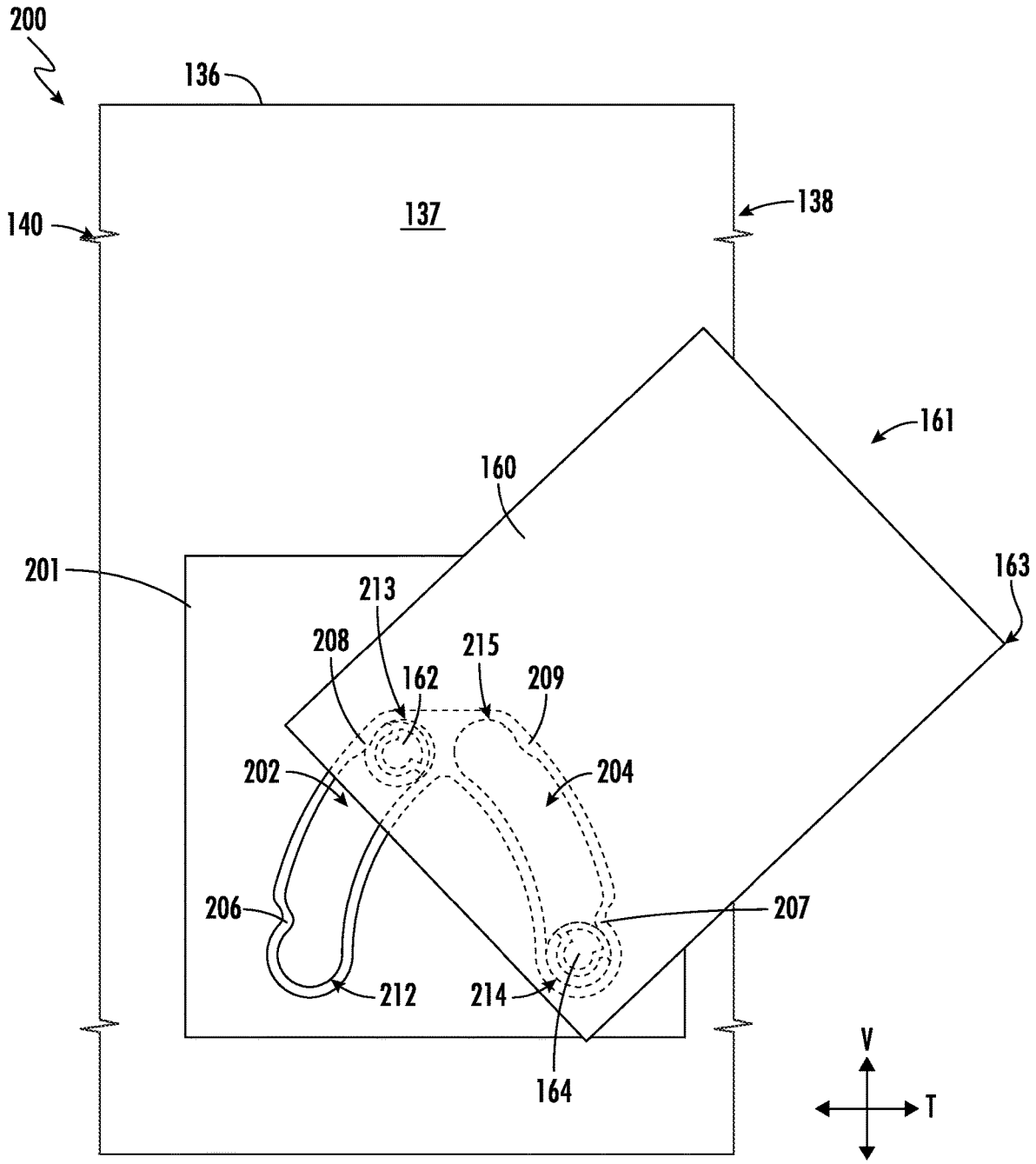
FIG. 7 provides a schematic side view of the tilting bin assembly of FIG. 5 in an outward position.

Turning now to FIGS. 3-7, illustrated in FIGS. 3-4 are example components of a tilting bin assembly 200 seen in FIGS. 5-7. In general, with regards to FIGS. 3-7, the vertical direction V, lateral direction L, and transverse direction T may be defined with respect to doors 126, 128, such as inner door 132, in the closed positioned, as illustrated in FIG. 1. In particular, FIG. 3 illustrates an example bin 160 of tilting bin assembly 200. In general, bin 160 may be rectangular in shape, extending between a top 163 and a bottom 171 in the vertical direction V, between a first side 165 and a second side 167 in the lateral direction L, and opposing sidewalls 169 in the transverse direction T. Bin 160 may generally define an opening 161 in the top 163 of bin 160 configured to receive food items for storage within bin 160. In general, bin 160 may include mounting nubs, e.g., a first nub 162 and a second nub 164, extending outwards in the lateral direction L from first side 165. In general, bin 160 and first and second nubs 162, 164 thereon may be molded, through processes such as injection molding, such that bin 160 and first and second nubs 162, 164 may be one-piece construction. In general, first nub 162 and second nub 164 of bin 160 may be positioned in a plane 172 defined by the lateral direction L and the transverse direction T. Plane 172 may be parallel to bottom 171 of bin 160. Additionally or alternatively, mounting nubs such as first and second nubs 162, 164 may extend outwards in the lateral direction L from second side 167. In particular, first and second nubs 162, 164 may couple bin 160 to a mounting plate within tilting bin assembly 200 as will be further described hereinbelow.

In general, first and second nubs 162, 164 may include protrusions 180 extending outwards in the lateral direction L, e.g., with respect to inner door 132 positioned in the closed position, from first and second nubs 162, 164. Protrusions 180 may generally be defined by a first end 182 and a second end 184. For example, as seen in FIG. 3, first end 182 of protrusion 180 may extend at a first radius, such as the radius of first and second nubs 162, 164, at least partially around a central axis of first and second nubs 162, 164, respectively. Second end 184 may extend at least partially around the central axis of first and second nubs 162, 164, respectively, at a smaller radius than first end 182. In other words, protrusion 180 may be mushroom-like in shape, defining a wider first end (a mushroom cap) and a narrower second end (a mushroom stem), such as may be seen by first and second ends 182, 184 of protrusion 180.

Turning now to FIG. 4, an example embodiment of a mounting plate 201 is provided. Mounting plate 201 may generally be removably coupled to inner door 132 via a mounting slot 220 in mounting plate 201. Mounting slot 220 may generally be configured to receive a knob/protrusion (not shown) extending from a first inner side wall 137 of frame 136 of inner door 132. In general, mounting plate 201 may be fixed and remain stationary when mounted to frame 136. Additionally or alternatively, a second mounting plate, such as another mounting plate 201, may be removably coupled to inner door 132 at a second inner side wall 139 of frame 136. In general, mounting plate 201 may mount bin 160 to inner door 132, such that bin 160 may be positioned within first inner side wall 137 and second inner side wall 139 of frame 136 of inner door 132. In general, first and second nubs 162, 164 of bin 160 may engage with mounting plate 201. For example, mounting plate 201 may define a first channel 202 and a second channel 204 configured to receive first nub 162 of bin 160 and second nub 164 of bin 160, respectively. In general, the first and second channel, 202, 204 may be molded within mounting plate 201. As will be described in further detail hereinbelow, first nub 162 may generally be configured to translate within first channel 202 and second nub 164 may generally be configured to translate within second channel 204.

In general, first channel 202 of mounting plate 201 may include a first end 212 proximate the bottommost edge 218 of mounting plate 201, e.g., first end 212 may be within the lower half of mounting plate 201, such as the lower third of mounting plate 201. In the present example embedment, first channel 202 may extend upward, from first end 212, in the vertical direction V and backwards, from first end 212, in the transverse direction T to a second end 213. In general, first channel 202 may curve between first end 212 and second end 213, as illustrated in FIG. 4. Furthermore, first channel 202 may generally include a first detent 206 and a second detent 208, where first detent 206 may be positioned proximate first end 212 and second detent 208 may be positioned proximate second end 213, e.g., first detent 206 may be spaced apart from first end 212 along the length of first channel 202 by no more than thirty percent (30%) of the length of first channel 202 and second detent 208 may be spaced apart from second end 213 along the length of first channel 202 by no more than thirty percent (30%) of the length of first channel 202. For example, first detent 206 may protrude into first channel 202 proximate first end 212 and second detent 208 may protrude into first channel 202 proximate second end 213. In general, second channel 204 may be a mirrored channel of first channel 202 across a plane 222 (illustrated as extending "into the page" in FIG. 4) defined by the vertical direction V and lateral direction L. In particular, second channel 204 may include a third detent 207 and a fourth detent 209, where third detent 207 may be positioned proximate a first end 214 of second channel 204 and fourth detent 209 may be positioned proximate a second end 215 of second channel 204, e.g., third detent 207 may be spaced apart from first end 214 along the length of second channel 204 by no more than thirty percent (30%) of the length of second channel 204 and fourth detent 209 may be spaced apart from second end 215 along the length of second channel 204 by no more than thirty percent (30%) of the length of second channel 204. For example, third detent 207 may protrude into second channel 204 proximate first end 214 and fourth detent 209 may protrude into second channel 204 proximate second end 215.

Turning now to FIGS. 5-7, tilting bin assembly 200 may generally be mounted within opening 118 of inner door 132. Accordingly, FIGS. 5-7 illustrate a side view of tilting bin assembly 200 such as viewed from second inner side wall 139 of frame 136 toward first inner side wall 137 in the lateral direction L. In general, bin 160 may be tilted in the transverse direction T between different positions. In general, to tilt bin 160, a user may exert force upon one of the opposing sidewalls 169 of bin 160, where the force may be determined by a diameter of nubs 162, 164 and the protrusion of the detents, e.g., first, second, third, and fourth detent 206, 208, 207, 209. Particularly, FIG. 5 illustrates bin 160 in a neutral position, FIG. 6 illustrates bin 160 in an inward position, and FIG. 7 illustrates bin 160 in an outward position. In general, when doors 126, 128 are in the closed position, such as in FIG. 1, tilting bin assembly 200 may be in the neutral position.

Referring specifically to FIG. 5, tilting bin assembly 200 is shown in the neutral position. The neutral position may be defined when both first nub 162 and second nub 164 of bin 160 are positioned within first end 212, 214 of the respective first channel 202 and second channel 204. In general, first detent 206 may protrude into first channel 202, such that first detent 206 may be configured to retain first nub 162 of bin 160 when first nub 162 is translated to first end 212 of first channel 202, such as the first detent 206 may be configured to retain first nub 162 in the first end 212 of the first channel 202, e.g., the first detent 206 may be spaced apart from the first end 212 by about the diameter of the first nub 162. In particular, first detent 206 may be configured to retain first nub 162 in the first end 212 of the first channel 202 via positively interfering with first end 182 of protrusion 180 on first nub 162. Similarly, third detent 207 may protrude into second channel 204, such that third detent 207 may be configured to retain second nub 164 of bin 160 when second nub 164 is translated to first end 214 of second channel 204, e.g., the third detent 207 may be spaced apart from the first end 214 by about the diameter of the second nub 164. In particular, third detent 207 may be configured to retain second nub 164 in the first end 214 of the second channel 204 via positively interfering with first end 182 of protrusion 180 on second nub 164. Accordingly, in the neutral position, first and second nub 162, 164 may be retained within first end 212, 214 of the respective first channel 202 and second channel 204.

Referring specifically to FIG. 6, tilting bin assembly 200 is shown in the inward position. In general, the inward position of bin 160 may include opening 161 of bin 160 tilted/orientated towards inner surface 140 of frame 136 of inner door 132. A user may desire tilting bin assembly 200 to be in the inward position in scenarios such as when inner door 132 is in the open position. In general, a user may pull on bin 160 in the transverse direction T, while inner door 132 is in the open position, in order to tilt bin 160 to the inward position. In particular, fourth detent 209 may protrude into second channel 204, such that fourth detent 209 may be configured to retain second nub 164 of bin 160 when second nub 164 is translated to second end 215 of second channel 204. Moreover, fourth detent 209 may be configured to retain second nub 164 in the second end 215 of the second channel 204 via positively interfering with second end 184 of protrusion 180 on second nub 164. Accordingly, in the inward position, first nub 162 may be retained within first end 212 of first channel 202 and second nub 164 may be retained within second end 215 of second channel 204.

Referring specifically to FIG. 7, tilting bin assembly 200 is shown in the outward position. In general, the outward position of bin 160 may include opening 161 of bin 160 tilted/orientated towards outer surface 138 of frame 136 of inner door 132. A user may desire tilting bin assembly 200 to be in the outward position in scenarios such as when inner door 132 is in the closed position. In general, a user may pull on bin 160 in the transverse direction T, while inner door 132 is in the closed position, in order to tilt bin 160 to the outward position. In other words, outer door 134 may be independently rotated away from outer surface 138 of frame 136 of inner door 132, exposing tilting bin assembly 200 for the user to tilt bin 160. In particular, second detent 208 may protrude into first channel 202, such that second detent 208 may be configured to retain first nub 162 of bin 160 when first nub 162 is translated to second end 213 of first channel 202. Moreover, second detent 208 may be configured to retain first nub 162 in the second end 213 of the first channel 202 via positively interfering with second end 184 of protrusion 180 on first nub 162. As such, in the outward position, first nub 162 may be retained within second end 213 of first channel 202 and second nub 164 may be retained within first end 214 of second channel 204.

As described above, tilting bin assembly 200 may be advantageous for a user standing outside of inner door 132 of refrigerator appliance 100 by having bin 160 tilt outwards, making access to articles/food items within bin 160 easier than accessing the food items from a bin that does not tilt. Bin 160 may be tilted back into the neutral position for outer door 134 to close. In a likewise manner, tilting bin assembly 200 may also advantageously tilt to the inward position, providing easier access for a user standing inside of doors 126, 128 of refrigerator appliance, e.g., doors 126, 128, including inner door 132, may be in the open position whereupon a user may stand between the opened doors 126, 128. In other example embodiments, other components may be used to achieve rotational boundaries of bin 160, e.g., the present example embodiment includes first and second channel 202, 204 with detents 206, 208, 207, 209. For example, other example embodiment may include spring loaded detents, or a cam shaft with features for limiting rotation.

As may be seen from the above, provided is a dual directional tilting door bin for a refrigerator. The dual tilt bin is a storage bin that tilts both forward and backward into a space in order to provide easier access to items stored within the bin. The dual tilt bin may have molded nubs on the ends of the bin that effectively ride along two molded channels in mounting plate, or saddle, of the bin. The saddle may be attached to a door of the refrigerator appliance. The saddle may remain stationary while the bin may be rotated along the confines of the nubs sliding along the channels. Small detent features in each channel allow for retaining the bin in different positions. The bin may be returned to a neutral position by exerting force to rotate the nub of the bin beyond the detent molded into the channel on the saddle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber extending between a top and a bottom along the vertical direction, a first side and a second side along the lateral direction, and a front and a back along the transverse direction;

a door-in-door assembly comprising:

an upper hinge assembly and a lower hinge assembly;

an inner door, the inner door comprising a frame defining an opening, the frame comprising an inner surface and an outer surface, the inner door rotatable between a closed position and an open position;

an outer door, wherein both the inner door and the outer door rotatably coupled to the upper hinge assembly and the lower hinge assembly, the outer door rotatable independently from the inner door; and a tilting bin assembly mounted within the opening of the inner door, the tilting bin assembly comprising:

a bin positioned within a first inner side wall and a second inner side wall of the frame of the inner door, the bin defining an opening at a top side of the bin, the bin comprising a first nub and a second nub positioned on a first side;

a mounting plate removably coupled to the frame of the inner door, the mounting plate defining a first channel and a second channel configured to receive the first nub and the second nub, respectively, of the bin, the first nub configured to translate within the first channel and the second nub configured to translate within the second channel, whereby, the bin tilts between an inward position and an outward position, wherein the inward position of the bin comprises the opening of the bin orientated towards the inner surface of the frame of the inner door when the inner door is in the open position, and the outward position of the bin comprises the opening of the bin orientated towards the outer surface of the frame of the inner door when the inner door is in the closed position.

2. The refrigerator appliance of claim 1, wherein the first nub and the second nub of the bin are positioned on the bin in a plane defined by the lateral direction and the transverse direction.

3. The refrigerator appliance of claim 1, wherein the first channel of the mounting plate comprises a first end proximate a bottom of the mounting plate, the first channel extends upward, from the first end, in the vertical direction and backward from the first end in the transverse direction to a second end when the inner door is in the closed position, the first channel curving between the first end and the second end.

4. The refrigerator appliance of claim 3, wherein the first channel comprises a first detent and a second detent, the first detent positioned proximate the first end and the second detent positioned proximate the second end.

5. The refrigerator appliance of claim 4, wherein the first detent protrudes into the first channel, the first detent configured to retain the first nub of the bin when the first nub is translated to the first end of the first channel.

6. The refrigerator appliance of claim 4, wherein the second detent protrudes into the first channel, the second detent configured to retain the first nub of the bin when the first nub is translated to the second end of the first channel.

7. The refrigerator appliance of claim 4, wherein the second channel comprises a mirrored channel of the first channel across a plane defined by the vertical direction and lateral direction when the inner door is in the closed position, the second channel comprising a third detent and a fourth detent, the third detent positioned proximate a first end of the second channel and the fourth detent positioned proximate a second end of the second channel.

8. The refrigerator appliance of claim 7, wherein the third detent protrudes into the second channel, the third detent configured to retain the second nub of the bin when the second nub is translated to the first end of the second channel.

9. The refrigerator appliance of claim 7, wherein the fourth detent protrudes into the second channel, the fourth detent configured to retain the second nub of the bin when the second nub is translated to the second end of the second channel.

10. The refrigerator appliance of claim 1, wherein the tilting bin assembly is configured to move to a neutral position when both the first nub and the second nub of the bin are positioned within the first end of the respective first channel and second channel.

11. A door-in-door assembly for a refrigerator appliance, the door-in-door assembly defining a vertical direction, a lateral direction, and a transverse direction, the vertical, lateral, and transverse directions being mutually perpendicular, the door-in-door assembly comprising:

an upper hinge assembly and a lower hinge assembly;

an inner door, the inner door comprising a frame defining an opening, the frame comprising an inner surface and an outer surface, the inner door rotatable between a closed position and an open position;

an outer door, wherein both the inner door and the outer door rotatably couple to the upper hinge assembly and the lower hinge assembly, the outer door rotatable independently from the inner door; and a tilting bin assembly mounted within the opening of the inner door, the tilting bin assembly comprising:

a bin positioned within a first inner side wall and a second inner side wall of the frame of the inner door, the bin defining an opening at a top side of the bin, the bin comprising a first nub and a second nub positioned on a first side;

a mounting plate removably coupled to the frame of the inner door, the mounting plate defining a first channel and a second channel configured to receive the first nub and the second nub, respectively, of the bin, the first nub configured to translate within the first channel and the second nub configured to translate within the second channel, whereby, the bin tilts between an inward position and an outward position, wherein the inward position of the bin comprises the opening of the bin orientated towards the inner surface of the frame of the inner door when the inner door is in the open position, and the outward position of the bin comprises the opening of the bin orientated towards the outer surface of the frame of the inner door when the inner door is in the closed position.

12. The door-in-door assembly of claim 11, wherein the first nub and the second nub of the bin are positioned on the bin in a plane defined by the lateral direction and the transverse direction.

13. The door-in-door assembly of claim 11, wherein the first channel of the mounting plate comprises a first end proximate a bottom of the mounting plate, the first channel extends upward, from the first end, in the vertical direction and backward from the first end in the transverse direction to a second end when the inner door is in the closed position, the first channel curving between the first end and the second end.

14. The door-in-door assembly of claim 13, wherein the first channel comprises a first detent and a second detent, the first detent positioned proximate the first end and the second detent positioned proximate the second end.

15. The door-in-door assembly of claim 14, wherein the first detent protrudes into the first channel, the first detent configured to retain the first nub of the bin when the first nub is translated to the first end of the first channel.

16. The door-in-door assembly of claim 14, wherein the second detent protrudes into the first channel, the second detent configured to retain the first nub of the bin when the first nub is translated to the second end of the first channel.

17. The door-in-door assembly of claim 14, wherein the second channel comprises a mirrored channel of the first channel across a plane defined by the vertical direction and lateral direction when the inner door is in the closed position, the second channel comprising a third detent and a fourth detent, the third detent positioned proximate a first end of the second channel and the fourth detent positioned proximate a second end of the second channel.

18. The door-in-door assembly of claim 17, wherein the third detent protrudes into the second channel, the third detent configured to retain the second nub of the bin when the second nub is translated to the first end of the second channel.

19. The door-in-door assembly of claim 17, wherein the fourth detent protrudes into the second channel, the fourth detent configured to retain the second nub of the bin when the second nub is translated to the second end of the second channel.

20. The door-in-door assembly of claim 11, wherein the tilting bin assembly is configured to move to a neutral position when both the first nub and the second nub of the bin are positioned within the first end of the respective first channel and second channel.

* * * * *